US006591762B1

(12) United States Patent
Haghayegh

(10) Patent No.: US 6,591,762 B1
(45) Date of Patent: Jul. 15, 2003

(54) CORNER SHELF ASSEMBLY

(76) Inventor: Alireza Haghayegh, 12721 NW. 7th Ave., Miami, FL (US) 33168

( * ) Notice: Subject to any disclaimer, the term of this patent is extended or adjusted under 35 U.S.C. 154(b) by 0 days.

(21) Appl. No.: 10/104,520

(22) Filed: Mar. 22, 2002

(51) Int. Cl.[7] ..... A47B 37/00
(52) U.S. Cl. ..... 108/42
(58) Field of Search ..... 108/42, 152; 211/88.01, 211/90.01, 87.01; 248/250, 235, 231.9, 231.91; 52/36.5, 36.6; 312/408

(56) References Cited

U.S. PATENT DOCUMENTS 1,452,515 A * 4/1923 Kearney et al.
1,476,834 A * 12/1923 Pleister
2,096,024 A * 10/1937 Anderson
2,261,078 A * 10/1941 Shockey
2,389,349 A * 11/1945 Eastman
3,033,376 A * 5/1962 Eastman
4,898,355 A * 2/1990 Steinway
4,928,913 A * 5/1990 Laughon et al.
5,513,575 A * 5/1996 Slade
5,983,805 A 11/1999 Waluda
6,164,610 A * 12/2000 Santiago
6,467,636 B1 * 10/2002 Schaefer

FOREIGN PATENT DOCUMENTS

EP 447316 A1 * 9/1991
EP 634121 A1 * 1/1995

* cited by examiner

*Primary Examiner*—Jose V. Chen
(74) *Attorney, Agent, or Firm*—J. Sanchelima; A. Bordas

(57) ABSTRACT

A corner shelf assembly for corner walls using a flat shelf member with two perpendicularly disposed edges. Each of the edges includes at least one tongue member that extends coplanarly and is removably inserted within respective casing members that are cooperatively mounted within openings at the corner walls. The casing members accepting the tongues from one of the edges are wider so that the flat shelf member can be slid horizontally after this first set of tongues is inserted. A latching mechanism is used to keep the flat shelf member in place. Alternatively, corner the shelf assembly may include locking clips that are inserted in the casings after the user inserts the tongues in the wider casings. The locking clips prevent lateral movements of the shelf assembly. The corner shelf assembly can be removed upon the application of a predetermined amount of lifting force to the shelf member.

4 Claims, 4 Drawing Sheets

CORNER SHELF ASSEMBLY

I. BACKGROUND OF THE INVENTION

1. Field of the Invention

The present invention relates to corner shelf assemblies and more particularly to the types that are used in wall corners.

2. Description of the Related Art

Many designs for corner shelves have been designed in the past. None of them, however, provides for a removably mounted shelf for wall corners with anchorage means that are covered by the shelf itself.

Applicant believes that the closest reference corresponds to U.S. Pat. No. 5,983,805 issued to Casey E. Waluda on Nov. 16, 1999 for a corner shelf assembly. The Waluda patented corner shelf includes left and right support members and a base plate. The left and right support members are in a perpendicular relationship with respect to each other. Each support member has a vertical arm including an opening and at least one base arm. Each of the base arm edges includes a tongue extending from the left base arm edge. However, it differs from the present invention because the tongues of the base arm edges in Waluda's patented invention are mounted to the support members. The support members are in turn mounted to the wall with means going through openings. The present invention on the other hand, is removably mounted to a corner wall by inserting its tongues in a casing member previously housed in the wall receiver opening. The shelf edges cover the openings that would otherwise detract from the aesthetics of the structure. No other supporting members are needed.

Other patents describing the closest subject matter provide for a number of more or less complicated features that fail to solve the problem in an efficient and economical way. None of these patents suggest the novel features of the present invention.

II. SUMMARY OF THE INVENTION

It is one of the main objects of the present invention to provide a corner shelf assembly that is removably mounted to a corner wall.

It is another object of this invention to provide a corner shelf assembly with a minimum number of visible supporting members that detract from the aesthetics of the assembly.

It is still another object of this invention to provide a corner shelf assembly that is inserted in cooperative receiver casings in wall openings that are substantially covered by the shelf assembly itself.

It is still another object of this invention to provide a corner shelf assembly with casings that prevent water from penetrating inside the wall hole.

It is still another object of the present invention to provide a corner shelf assembly that includes a cover with cooperative dimensions to be inserted in the receiver casing when no corner shelf assemblies are mounted. This enhances the flexibility of using different shelf members.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

III. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 3:
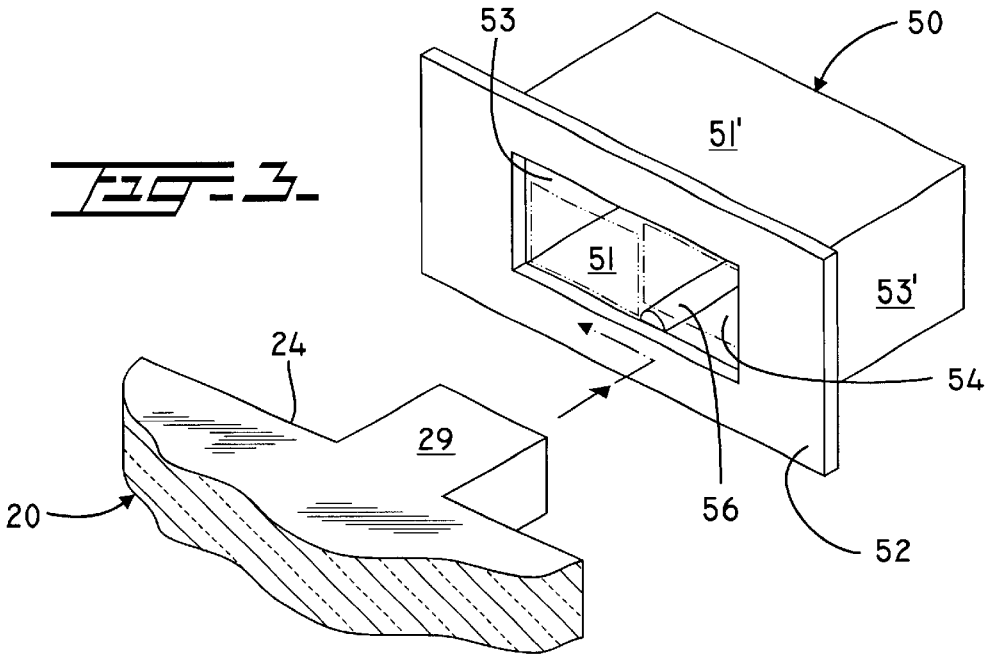

FIG 3. is an isometric view of one of the casings and a portion of a shelf member. The initial and final positions of the tongue are shown in phantom.

Figure 1:
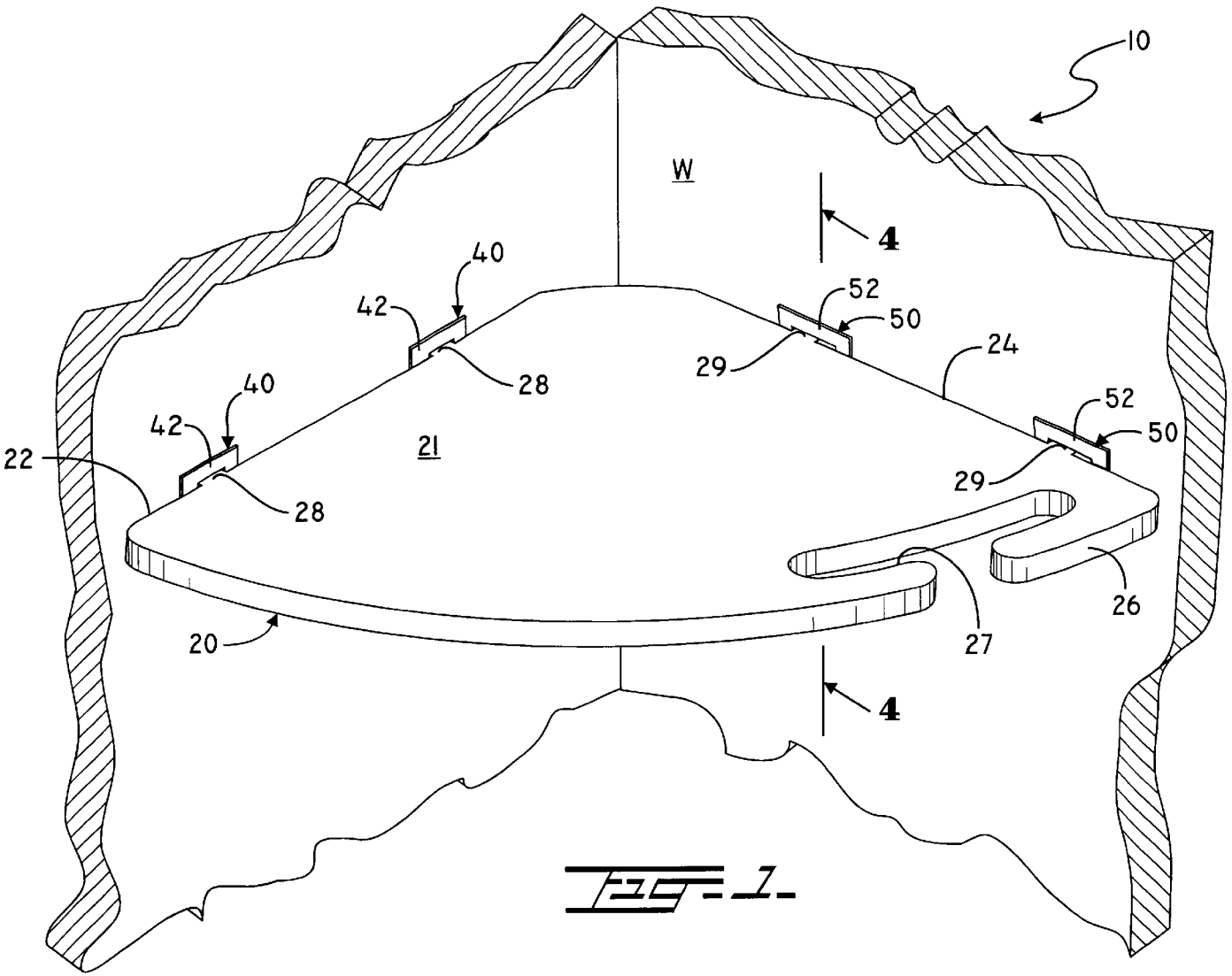
FIG. 1 shows an isometric view of the corner shelf assembly, object of the present application, mounted to a wall corner.
Figure 4:
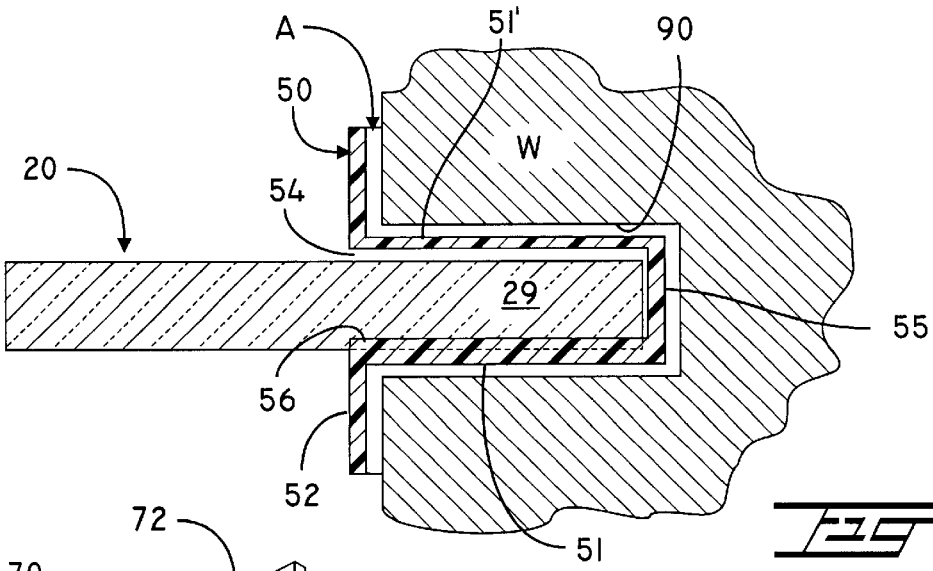

FIG. 4 illustrates a cross-sectional view taken along line 4—4 in FIG. 1, of a casing inserted in a wall opening.

Figure 5:
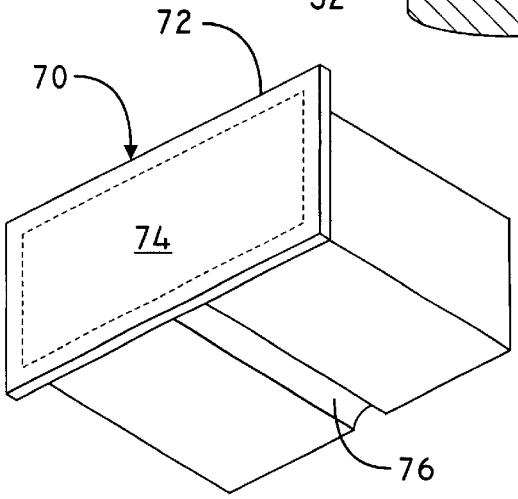

FIG. 5 represent an isometric view of the cover for the casing showing its cooperating bottom groove.

Figure 6:
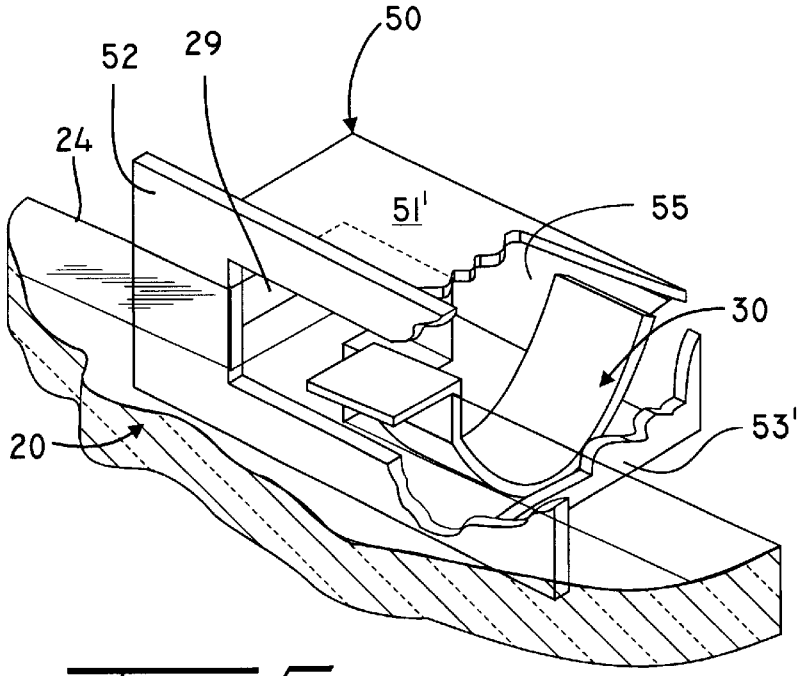

FIG. 6 is an isometric broken detail view of the casing assembly with a partial representation of a flat shelf member showing an alternate embodiment using a locking clip.

Figure 7:
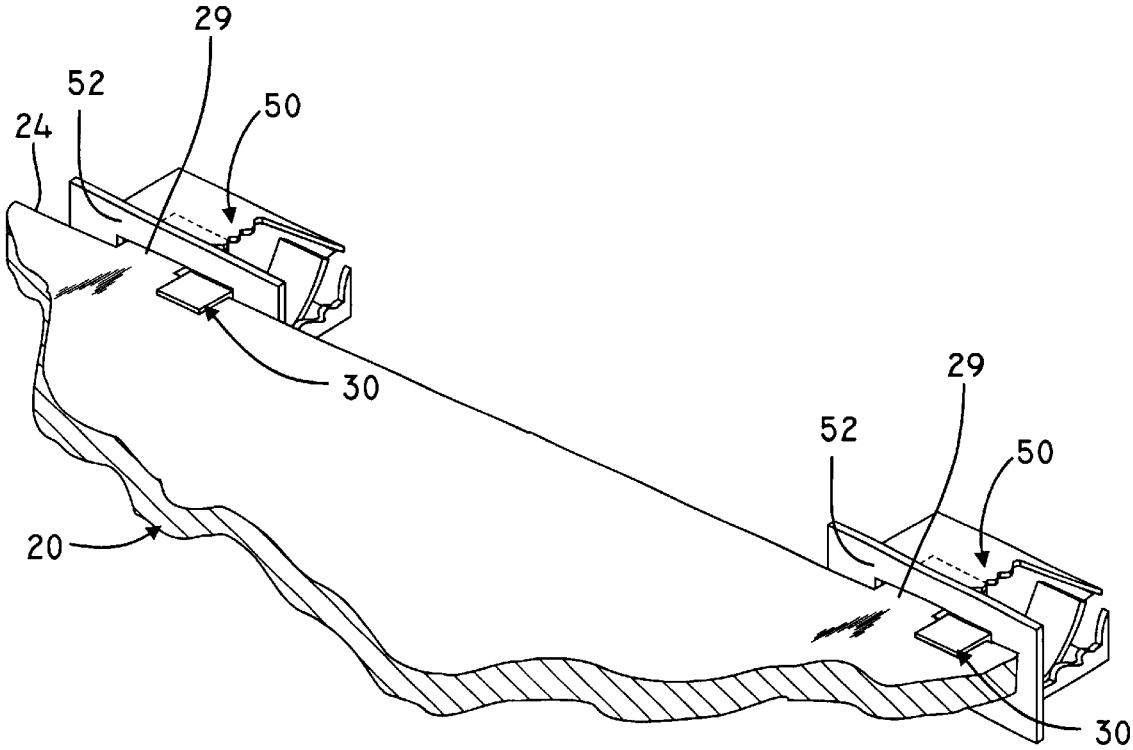

FIG. 7 shows an isometric view of the alternate embodiment with locking clip shown in FIG. 6, mounted to a wall corner. The shelf member is partially represented.

IV. DETAILED DESCRIPTION OF THE PREFERRED EMBODIMENT

Referring now to the drawings, where the present invention is generally referred to with numeral 10, it can be observed that it basically includes flat shelf member 20, casings 40 and 50 inserted in openings 80 and 90.

Figure 2:
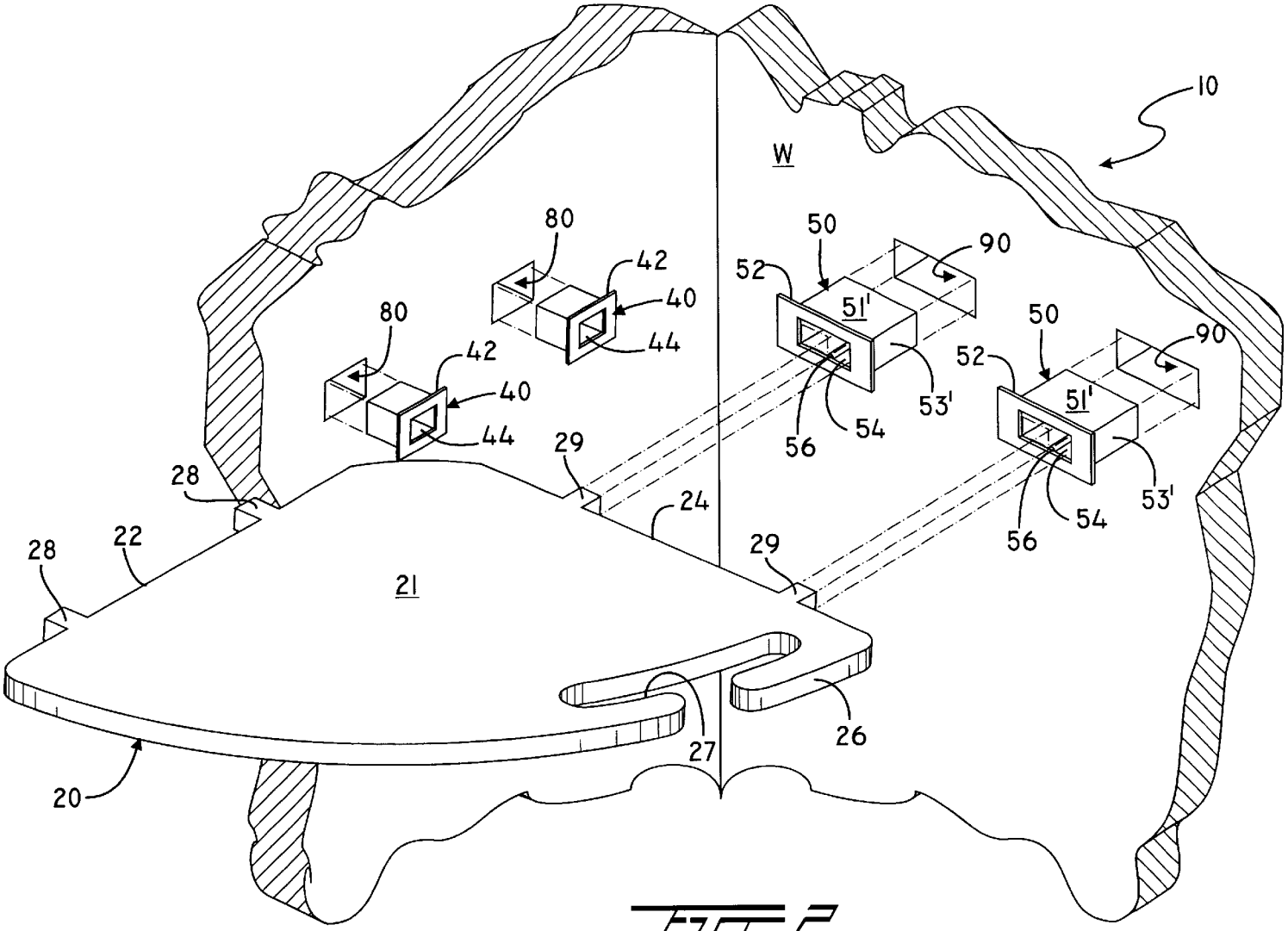
FIG. 2 represents an exploded view of one of the preferred embodiments for the corner shelf assembly, object of the present application being mounted to a corner wall with the casings aligned with corresponding wall cooperating openings.

In FIG. 1, corner shelf assembly 10 is represented mounted to a corner wall. Member 20 is shown in FIG. 2 in alignment with one pair of casings 50 that are also aligned with wall openings 90. Tongues 28 (and 29) are removably mounted to casings 40 (and 50). Tongues 28 (and 29) protrude from edge 22 (and 24) for insertion into corresponding casings 40 (and 50), which in turn are inserted in openings 80 (and 90) in walls W. For installation, after tongues 29 are inserted inside casing 50, towards the right (away from the corner) so that tongues 28 clear casings 40. Subsequently, member 20 is slid toward casings 40 receiving tongues 28 therein. Tongues 28 and 29 have, in the preferred embodiment, substantially the same dimensions. The width of tongues 28 and 29 is approximately one half the width of cavity 54. When tongues 29 are slid towards the corner they overcome rib member 56 which has cooperative dimensions to permit its compression upon the application of a force of a predetermined magnitude.

As shown in FIGS. 1 and 2, flat shelf member 20 has a substantially right-angled corner. The upper surface 21 of flat member 20 provides an area to support shampoos, rinses, razors, and other accessories. Additional shelves can be installed for decoration purposes, supporting plants, figurines, or other decorative items. Edges 22 and 24 are disposed at a perpendicular relationship with respect to each other to conform to corner walls W typically found in bathrooms. Flat shelf member 20 also includes outer edge 26 connecting edges 22 and 24. In the preferred embodiment, edge 26 has a rounded contour including cut out 27 to hold brushes, scrubs, wash clothes, etc. Edge 26 may have different contours for ornamental purposes. Edges 22 and 24 include tongues 28 and 29 that extend perpendicularly with respect to each other. In the preferred embodiment, corner 23 is rounded to prevent accumulation of water in that area.

Casings 40, as shown in FIG. 2, have a cooperative shape to receive tongues 28 therein. Casings 40 are inserted in openings 80 of corner walls W. Openings 80 have cooperative dimensions to snugly receive casings 40 therein. Openings 80 are conveniently disposed in corner walls W to coincide with tongues 28. Casings 40 include frame 42 extending perpendicularly outwardly from walls 41 and 43. Walls 41 and 43 are kept at a spaced apart and parallel relationship with respect to each other, defining cavity 44 therein. Casings 40 are inserted in openings 80 and optionally secured with adhesive material A to wall W. Frames 42 are kept outside openings 80 covering the edges and protecting wall W from water exposure.

Casings 50, as shown in FIG. 2, receive tongues 29 therein. Casings 50 are inserted in cooperatively disposed openings 90 of corner walls W. Openings 90 have cooperative dimensions to snugly receive casings 50 therein. Openings 90 are conveniently disposed in corner walls W to coincide with tongues 29. Casings 50 are wider than casings 40 by a predetermined additional width that coincides with the length of tongues 28. Casing 50 includes bottom wall 51, top wall 51', lateral walls 53 and 53' and rear wall 55. Casing 50 also includes frame 52 that extends perpendicularly outwardly from the outer edges of walls 51; 51'; 53 and 53'. As best shown in FIG. 3, rib member 56 extends longitudinally on bottom wall 51 of casings 50. Rib member 56 extends in a spaced apart and parallel relationship with respect to lateral walls 53 and 53'. Rib member 56 is intended to provide a protuberance that requires the exertion of a force of a predetermined magnitude for tongue 29 to overcome it. Cavities 44 and 54 are slightly larger vertically than the thickness of tongues 28 and 29, respectively, to permit slight (upward) movement of tongue 29 as it is force to overcome rib member 56.

Like casings 40 in openings 80, casings 50 are inserted in openings 90 and secured with adhesive material A to wall W, as seen in FIG. 4. Frames 52 are kept outside openings 90 covering their edges and protecting wall W from water exposure.

For installation of corner shelf assembly 10, the user inserts tongues 29 in casings 50 next to walls 51' and 53'. Then, tongues 29 are slid towards walls 51 and 53 until tongues 28 are fully inserted inside cavities 44 of casings 40. Tongues cammingly overcome rib member 56 upon.

Covers 60 and 70 have cooperative dimensions to be snugly received within casings 40 and 50, respectively, when no corner shelf 10 is mounted to corner walls W. Cover 60 (and 70) also includes surface 64 (and 74) at its outer portion. When cover 60 (and 70) is inserted to casings 40 and 50), walls W show a flush surface. As seen in FIG. 5, cover 70 also includes cooperative groove 76 for receiving rib member 56 therein.

Alternatively, corner shelf assembly 10 may include locking clip 30 instead of using rib member 56 and groove 76. Locking clips 30 are inserted in casings 50 after the user moves tongues 29 in casings 50 towards casings 40. Locking clips 30 push tongues 29 against lateral walls 53 occupying the free space in cavities 54. Locking clips 30 avoid shelf assembly 10 from lateral moving.

Corner shelf assembly 10 can be removed upon the application of a predetermined amount of lifting force to shelf member 20 in the embodiments represented in FIGS. 1; 2; 3 and 4. For the embodiments represented in FIGS. 6 and 7, locking clips 30 must be removed before the application of a predetermined amount of lifting force to shelf member 20. The objective being to immobilize shelf member 20 in position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A corner shelf assembly, comprising;

A) a flat shelf member having first and second edges that extend substantially perpendicularly with respect to each other and conform to first and second interior surfaces of a corner wall, respectively, said first edge including at least one first tongue member coplanarly extending from said first edge, and said second edge including at least one second tongue member coplanarly extending from said second edge;

B) at least one first casing member mounted inside said first interior surface at a cooperative coplanar location to receive said at least one first tongue member and at least one second casing member mounted inside said second interior surface at a cooperative coplanar location to receive said at least one second tongue member, and said at least one first casing member having a predetermined width that is larger than the width of said at least one second casing member thereby permitting said flat member to be displaced towards said at least one second casing member after said at least one first tongue member has been fully inserted within said at least one first casing member.

2. The assembly set forth in claim 1 further including;

C) latching means for keeping said at least one first and second tongue members inserted within said at least one first and second casing members and permitting the removal of said flat shelf member upon the application of a predetermined amount of force.

3. The assembly set forth in claim 2 wherein said latching means includes a rib member longitudinally positioned within said at least one first casing member so that said at least one first tongue member snugly fits within said at least one casing member and said rib member thereby immobilizing said at least one first tongue member.

4. The assembly set forth in claim 2 where said latching means includes a clip that is removably inserted in said at least one first casing member to immobilize said at least one first tongue member.

* * * * *